US005859586A

United States Patent [19]

Sasagawa et al.

[11] Patent Number: 5,859,586

[45] Date of Patent: Jan. 12, 1999

[54] ELECTRONIC ARTICLE SURVEILLANCE SYSTEM

[75] Inventors: Shinichi Sasagawa; Seishi Namioka; Nobuyuki Ichimiya; Shin Kinouchi, all of Miyagi-ken, Japan

[73] Assignee: Alps Electric Co., Ltd., Tokyo, Japan

[21] Appl. No.: 613,933

[22] Filed: Mar. 11, 1996

[30] Foreign Application Priority Data

Mar. 16, 1995 [JP] Japan ..... 7-057554

[51] Int. Cl.[6] ..... G08B 13/14

[52] U.S. Cl. ..... 340/572; 340/571; 340/551; 340/568

[58] Field of Search ..... 340/572, 571, 340/551, 568

[56] References Cited

U.S. PATENT DOCUMENTS

| | | | |
|---|---|---|---|
| 4,135,183 | 1/1979 | Heltemes | 340/572 |
| 4,135,184 | 1/1979 | Pruzick | 340/572 |
| 4,686,513 | 8/1987 | Farrar et al. | 340/572 |
| 5,126,749 | 6/1992 | Kaltner | 343/742 |
| 5,221,831 | 6/1993 | Geiszler | 235/440 |
| 5,327,118 | 7/1994 | Drucker et al. | 340/572 |
| 5,589,819 | 12/1996 | Takeda | 340/571 |

FOREIGN PATENT DOCUMENTS 5-185776 7/1993 Japan .

*Primary Examiner*—Jeffery A. Hofsass
*Assistant Examiner*—Benjamin C. Lee
*Attorney, Agent, or Firm*—Brinks Hofer Gilson & Lione

[57] ABSTRACT

An E.A.S. capable of surely detecting magnetic fluxes emitted from transmission antennas irrespective of the position of a reception coil within a tag attached to goods. In order to emit magnetic fluxes into an aisle through which customers pass, the system is equipped with at least two transmission antennas 1, 3. These transmission antennas 1, 3 are driven in a time-sharing way so as not to concurrently emit the magnetic fluxes.

9 Claims, 8 Drawing Sheets

ELECTRONIC ARTICLE SURVEILLANCE SYSTEM

BACKGROUND OF THE INVENTION

1. Field of the Invention

The present invention relates to an Electronic Article Surveillance System (hereinafter referred to as "E.A.S." system), and more particularly, to an E.A.S. system which is designed to radiate or emit a magnetic flux in a doorway to a store or the like so that a tag attached to goods is responsive to the magnetic flux in order to monitor whether the goods are being illegally taken out from the store without being processed by a cashier.

2. Description of the Prior Art

Such a known E.A.S. is generally made such that an antenna for magnetic flux radiation constructed with a plane coil is installed in a doorway to a store to continuously radiate a magnetic flux into the doorway while a tag incorporating a coil made to serve as a reception antenna is attached to all goods in the store so that the coil of the tag detects the magnetic flux therefrom in the doorway to issue an alarm in response to detection when goods unprocessed by a cashier are being taken out from the store.

Referring to the drawings, a description will be made hereinbelow of the relationship between a transmission antenna and a reception antenna in a prior art E.A.S. system.

FIGS. 9A and 9B are illustrations of a magnetic flux radiated from a transmission antenna and a configuration of the transmission antenna, FIGS. 10 to 12 are illustrations available for the explanation of the direction of a reception coil and a reception sensitivity, and FIG. 13 is an illustration useful for the description of a tag attached to goods. In FIGS. 9 to 13, designated at 1 and 2 are a transmission antenna and a reception antenna, respectively.

As shown in FIG. 13, a tag having a reception coil 2 and an alarm circuit is generally attached to all goods in a store through string or the like which is breakable and removable by the customer or shopper. When the customer takes the goods out of the store, the reception coil 2 of the tag detects a magnetic flux from a transmission coil, which will be described later, and activates the alarm circuit. Thus, the alarm circuit sounds an alarm to inform clerks. In addition, when the string is broken by the customer, or is disconnected therefrom, the alarm circuit is also capable of issuing an alarm.

The transmission antenna 1 is, as shown in FIG. 9A, of a loop antenna type constructed on a plane, and is disposed on a floor in the doorway of the store or elsewhere. The transmission antenna 1 emits, as a signal being inputted thereto, a magnetic flux indicated at G in FIG. 9A. The radiation area of the magnetic flux is limited to the area in which the customers go in and out. The reception coil 2, acting as a reception antenna set within the tag attached to the goods, is, as shown in FIGS. 10 to 12, constructed in a manner of winding a piece of conductive wire into a ring-like configuration. When the customer tries to take the goods out of the store, the reception coil 2 receives the magnetic flux G from the transmission coil 1 to cause the alarm circuit, not shown, to issue an alarm.

However, in the case of monitoring the pilferage or theft by a combination of the transmission antenna 1 being situated on or in the floor and the reception coil 2 being attached to the tag, there is a possibility that the reception coil 2 cannot sense the magnetic flux G from the transmission antenna 1 when the reception coil 2 assumes certain positions with respect to the goods taken out.

A description will further be made of the detection sensitivity depending upon the position of the reception coil 2 with respect to the magnetic flux G to be emitted from the transmission antenna 1 on the floor.

In FIG. 10, the X axis, being one axis passing through the center of the transmission antenna 1 on the floor, extends along the direction of the doorway. FIG. 10 shows the state in which the customer walks along the X axis and attempts to take the goods out of the store. Further, in this case, in the reception coil 2 within the tag, as shown, an axis perpendicularly intersecting a ring of the reception coil coincides with the Z axis normal to the floor surface. In FIG. 10, the reception coil 2 is drawn in a state that the ring constituting the reception coil 2 is cut off along the X-Z plane, and the actual configuration thereof is circular as shown in FIGS. 11 and 12.

Further, as shown in FIG. 10, when the axis of the reception coil 2 directs to the Z axis direction, as indicated by the bold lines, a number of magnetic fluxes G can cross the reception coil 2, with the result being that the reception coil 2 is able to sense the magnetic fluxes G with a high degree of sensitivity.

On the other hand, FIG. 11 shows the case in which the axis of the reception coil 2 turns to the X axis direction, i.e., extends along the direction of the doorway. In this case, the magnetic flux G crossing the reception coil 2 becomes zero when the reception coil 2 stands right above the transmission antenna 1. Further, when the reception coil 2 is slightly separated from the transmission antenna 1, the magnetic flux G slightly crosses the reception coil 2. Accordingly, in the case of an example as shown in FIG. 11, the reception coil 2 is able to detect the magnetic flux G with an intermediate sensitivity.

Moreover, if, as shown in FIG. 12, the axis of the reception coil 2 turns to the y axis direction, i.e., extends in a direction perpendicular to the direction of the doorway, then the magnetic flux G from the transmission antenna 1 fails to cross the reception coil 2 irrespective of the reception coil 2 being moved in any way within the X-Z plane. For this reason, in the example as shown in FIG. 12, the reception coil 2 is able to sense the magnetic flux D with only an extremely low sensitivity, or cannot detect it at all.

Although in FIGS. 10 to 12, the illustrations are made such that the reception coil 2 passes just above the X axis, in a case where the reception coil 2 is shifted from the X axis and is transferred in parallel to the X axis, even in the case as shown in FIG. 12, the reception coil 2 can detect the magnetic flux G, but with a low sensitivity.

As described before, an antenna system of antipilferage equipment based on the prior art suffers from the problem that because of the position of the reception coil working as the reception antenna within a tag attached to the goods, difficulty is encountered in detecting pilferage when the goods assumes a certain positions.

SUMMARY OF THE INVENTION

The present invention has been developed with a view towards eliminating the aforesaid prior art problem, and it is therefore an object of the present invention to provide an E.A.S. system which is capable of dependably sensing the magnetic flux emitted from a transmission antenna regardless of the directions of a reception coil serving as a reception antenna within a tag attached to goods, thus enhancing the antipilferage effects of goods.

For this purpose, in accordance with the present invention, in an E.A.S. system in which a reception coil within a tag attached to goods senses the magnetic flux radiated from a transmission antenna in order to monitor whether the goods are being taken out without being processed by the cashier, at least two transmission antennas for emitting magnetic fluxes are located at a doorway for customers, and each of the transmission antennas is actuated in a time-sharing or time-division way so that the transmission antennas do not simultaneously radiate the magnetic fluxes.

Since the plurality of transmission antennas emit magnetic fluxes, the magnetic fluxes are able to cover a wide range, and since the reception sensitivity does not become lower over the entire magnetic flux radiated range, irrespective of the directions of the reception coil, the reception coil can surely detect the magnetic fluxes radiated, thereby dependably monitoring any pilferage.

More specifically, even if the reception coil within the tag passes in such a direction that the sensitivity is at its lowest point relative to the magnetic flux from one antenna, since the other antennas take different positions so that the magnetic fluxes from such other antennas have a different orientation with respect to the direction of the reception coil, the reception coil can dependably detect the magnetic fluxes therefrom to issue an alarm.

Moreover, since the plurality of transmission antennas are driven in the time-sharing way so as not to concurrently emit magnetic fluxes, the magnetic fluxes do not cancel each other and hence can cover a wider range, besides, the transmission power for the magnetic flux radiation is equal to only that needed for one antenna, with the result being that the power consumption of the transmitter is reducible.

BRIEF DESCRIPTION OF THE DRAWINGS

The object and features of the present invention will become more readily apparent from the following detailed description of the preferred embodiments taken in conjunction with the accompanying drawings in which.

DETAILED DESCRIPTION OF THE INVENTION

Figure 1A:
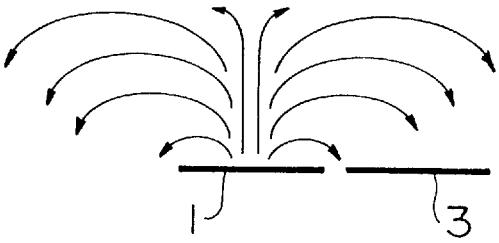
FIGS. 1A and 1B are illustrations of states of magnetic fluxes emitted in the case in which two transmission antennas are driven in a time-sharing way in an E.A.S. system according to an embodiment of this invention.

Referring now to the drawings, a detailed description will be made hereinbelow of an E.A.S. system according to an embodiment of the present invention.

Figure 1B:
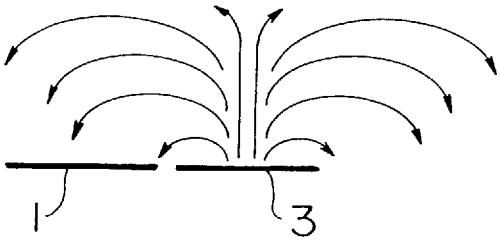
Figure 2:
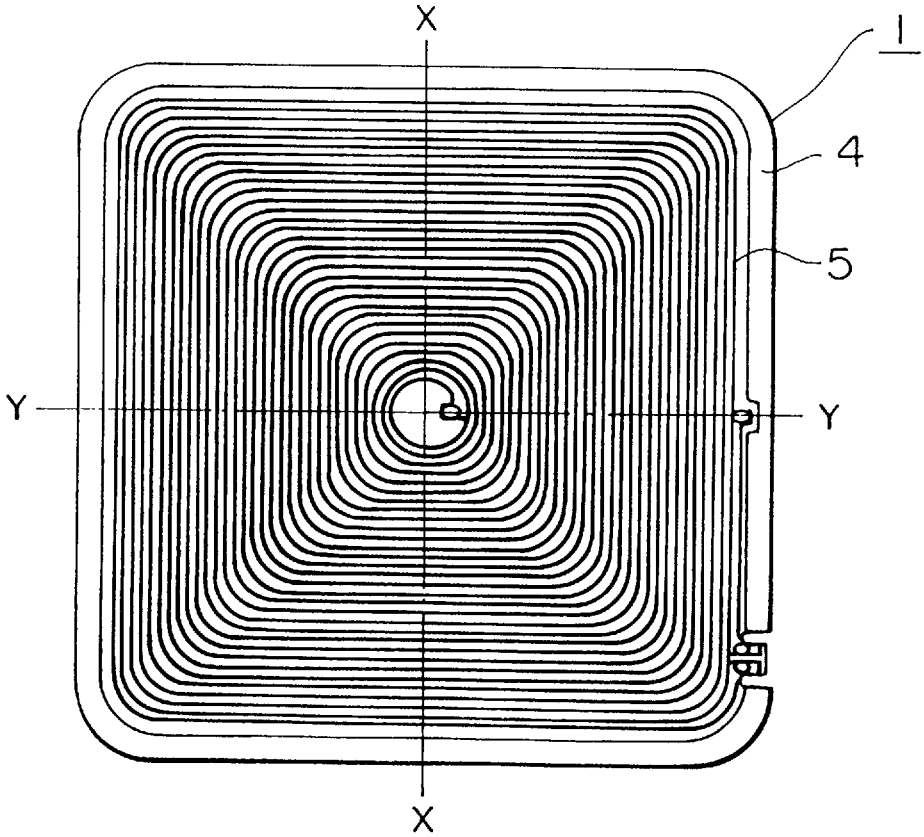
FIG. 2 is an illustration of one example of a conductor pattern of a transmission antenna.
Figure 3:
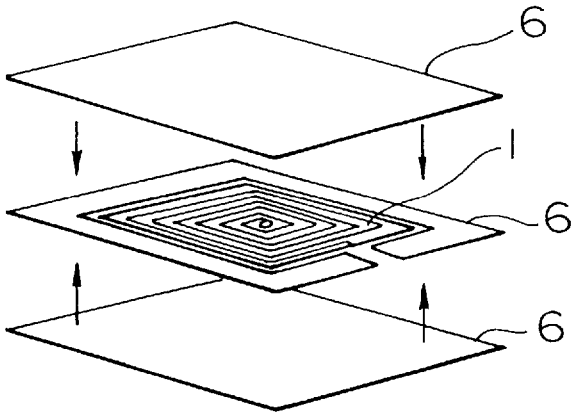
FIG. 3 is an illustration of an example of a construction of an antenna.
Figure 4:
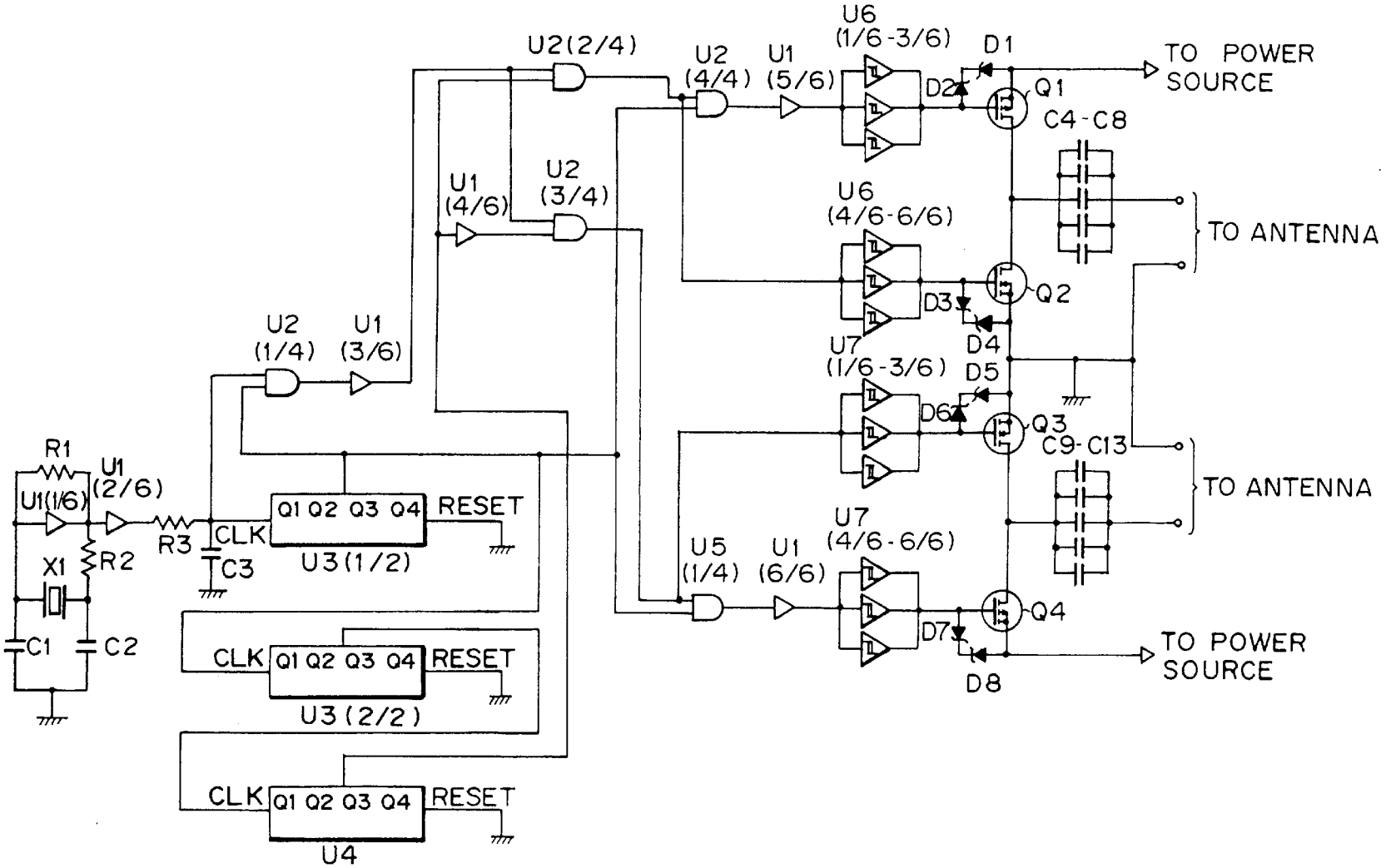
FIG. 4 is an illustration of an example of a circuit of a transmitter in a case in which two antennas are alternately driven.

FIGS. 1A and 1B are illustrations of states of magnetic fluxes emitted in the case in which two transmission antennas are driven in a time-sharing way in an E.A.S. system; FIG. 2 is an illustration of one example of a conductor pattern of a transmission antenna; FIG. 3 is an illustration of an example of a construction of an antenna; and FIG. 4 is an illustration of an example of a circuit of a transmitter in a case in which two antennas are alternately driven. In FIGS. 1 to 3, reference numeral 1 represents a first transmission antenna, numeral 3 designates a second transmission antenna, numeral 4 depicts a printed substrate, numeral 5 denotes a conductor pattern, and numeral 6 signifies protective members.

As illustrated in FIGS. 1A and 1B, the first and second transmission antennas 1, 3 are alternately actuated in a time-sharing way so as not to simultaneously radiate the magnetic fluxes G. For this reason, the magnetic fluxes G emitted from the adjacent portions of the first and second transmission antennas 1, 3 can be emitted over a wide range without cancelling each other.

Figure 13:
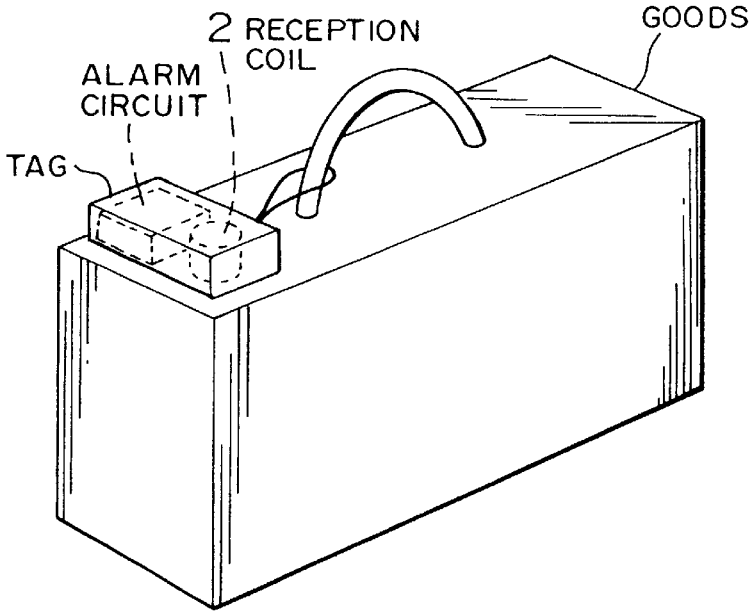
FIG. 13 is an illustration of a tag attached to goods.

Thus, when goods equipped with a tag incorporating a reception coil 2, as noted with reference to FIG. 13, approach these two transmission antennas, the reception coil 2 within the tag can be responsive to the magnetic flux from at least one of the transmission antennas 1, 3 irrespective of the direction of the reception coil 2, whereupon an alarm circuit issues an alarm.

Each of the first and second transmission antennas 1, 3 is, as shown in FIG. 2 (illustrating the first antenna 1), constructed in such a manner that, for example, a printed substrate 4 having a metallic foil such as an aluminium foil is etched to produce a conductor pattern 5 which constitutes a plane coil. The transmission antenna based on this plane coil is made to radiate a magnetic flux in a direction normal to the paper surface.

Although the printed substrate 4 forming the transmission antennas 1, 3 is producible with a general material such as a bakelite and a paper epoxy material, in the case that the transmission antennas 1, 3 are placed on a floor surface, a glass epoxy material or the like is most preferable because the need for it to endure frequent trampling by customers.

Being put into practical use, the transmission antennas 1, 3, as stated above, are interposed between the protective members 6 as shown in FIG. 3. Although the protective members 6 are most preferable to be made of a rubber or the like, in a case where the transmission antennas 1, 3 are disposed on a floor surface, there is a need for them to be resistent against trampling, and hence a plastic material or the like other than rubber is also usable. In addition, in the case in which the transmission antennas 1, 3 are used in a state standing perpendicularly to the floor surface, the protective members 6 are producible with any material if it allows the magnetic flux to pass therethrough, for example, a plastic film with an excellent decorative property can be put in practical use.

Secondly, in conjunction with FIG. 4, a description will be made hereinbelow of one example of a transmission circuit for the actuation of the two transmission antennas 1, 3. The description will start with the periodical conditions for the magnetic fluxes being alternately emitted from the two transmission antennas 1, 3. Let it be assumed that a person who tries to take goods out passes through in a range the magnetic fluxes from the two transmission antennas 1, 3 is able to cover. At this time, one of the transmission antennas 1, 3 deactuates, and the reception coil within the tag attached to the goods must be able to sense the magnetic flux emitted from the other transmission antenna. Accordingly, the period is preferably longer than the period for the reception coil to detect the magnetic flux from the one transmission antenna and to actuate. That is, the time that the reception coil within the tag receives the magnetic flux shortens as the aforesaid period decreases. The circuit including the reception coil within the tag is designed to prevent a malfunction due to noises, and in the case of an extremely short period such as 20 kHz:50 $\mu$sec, difficulty is encountered in distinguishing from noises. For this reason, one transmission antenna needs to continuously emit the magnetic flux for longer than a given time period, and in order to distinguish from noises, the time is desirably over 20 msec (50 Hz).

On the other hand, for exhibiting the effects of this invention, the two transmission antennas 1, 3 are required to alternately emit the magnetic fluxes once or more within the time period in which the person attempting to remove the goods passes through the magnetic flux reaching range. Thus, in a case where the aforesaid period is extremely short, for example, in the case of 2 Hz:500 msec, there is a possibility that the person who is holding the goods will pass through the range of the emitted magnetic flux when the sensitivity of the reception coil within the tag is low in relation to the magnetic flux radiated from one transmission antenna, and hence a failure to detect the pilferage can occur. Therefore, the aforesaid period is required to be below a given value, and taking into account the speed at which a person runs, the period is desirable to be set to below 67 msec (15 Hz). Consequently, the switching period for the two transmission antennas to be alternately switched in a time-sharing way is desirable to be between 20 msec (50 Hz) and 67 msec (15 Hz).

In the transmission circuit shown in FIG. 4, the switching is made with 16 Hz. A brief description will be made hereinbelow of this circuit. In the illustration, a basic frequency is produced with a crystal oscillator X1 of 32.768 kHz, and is then divided by frequency dividers U3, U4 to 1/2048 to produce a frequency of 16 Hz, which in turn is used as the switching period for the first and second transmission antennas 1, 3. The magnetic fluxes are established due to a signal with a frequency of 32.768 kHz which is the basic frequency, and are alternately emitted from the first and second transmission antennas 1, 3.

That is, in the circuit illustrated the 16-Hz signal made by the dividers U3, U4 is developed into a signal logically inverted through an inverter circuit U1 and into a signal which is not logically inverted. The non-inverted 16-Hz signal and the basic frequency signal operate the first transmission antenna 1 through a transmission output means comprising transistors Q1, Q2, while the logically inverted 16-Hz signal and the basic frequency signal drive the second transmission antenna 3 through a transmission output means comprising transistors Q3, Q4.

In accordance with the E.A.S. system according to the embodiment of this invention as described above, since the two transmission antennas are used and driven in a time-sharing way, the magnetic flux can be emitted over a wide range. In addition, since the reception sensitivity depending upon the direction of the reception coil does not result in being low in the entire magnetic flux emitted range, the reception coil can surely detect the magnetic flux emitted, thus enabling certainly detection of the pilferage. Moreover, since the two transmission antennas are driven in a time-sharing way so as to not concurrently radiate the magnetic fluxes, the magnetic fluxes do not cancelled each other and can be radiated over a wider range. In this case, the transmission power for the magnetic flux radiation is allowed to be a value corresponding to one antenna, with reduced transmitter power consumption.

Figure 5:
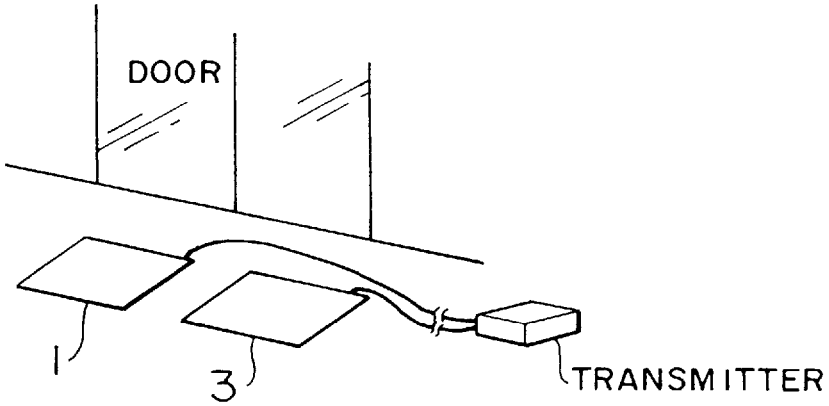
FIG. 5 is an illustration of an example in which two transmission antennas are disposed on a floor in a doorway of a store.
Figure 6:
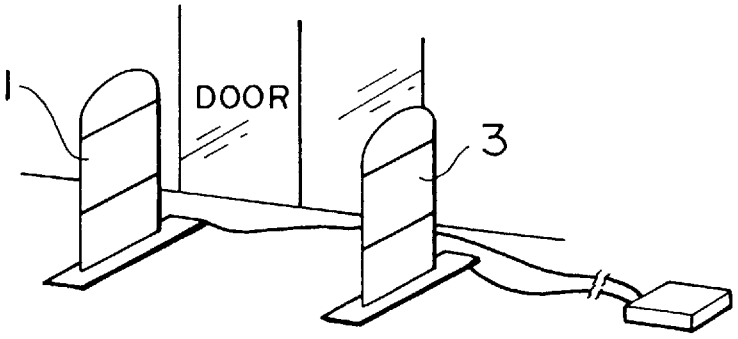
FIG. 6 is an illustration of an example in which two transmission antennas are vertically placed on a floor and at both sides in a doorway.
Figure 7:
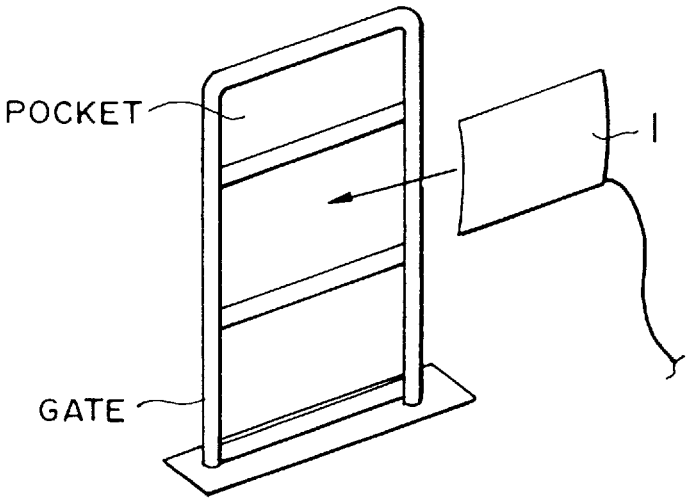
FIG. 7 is an illustration of an arrangement of a gate useful for vertically setting transmission antenna.
Figure 8:
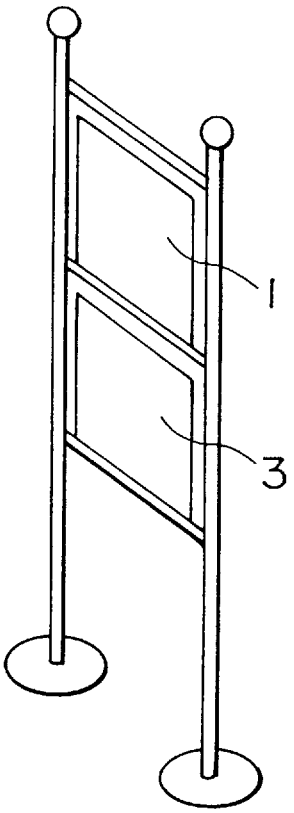
FIG. 8 is an illustration of an example in which two transmission antennas are situated vertically on a floor and at one side in a doorway.
Figure 9A:
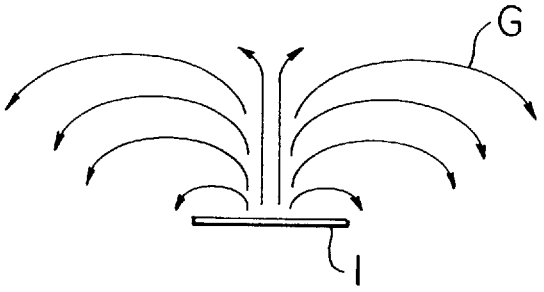
FIG. 9A is an illustration of a state of a magnetic flux emitted from a transmission antenna according to the prior art.
Figure 9B:
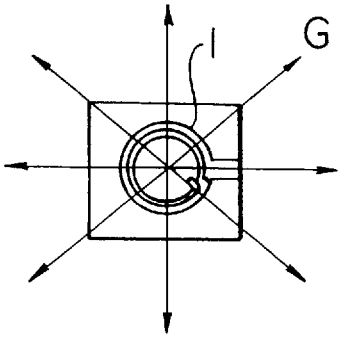
FIG. 9B is an illustration of a configuration of the mating reception coil.
Figure 10:
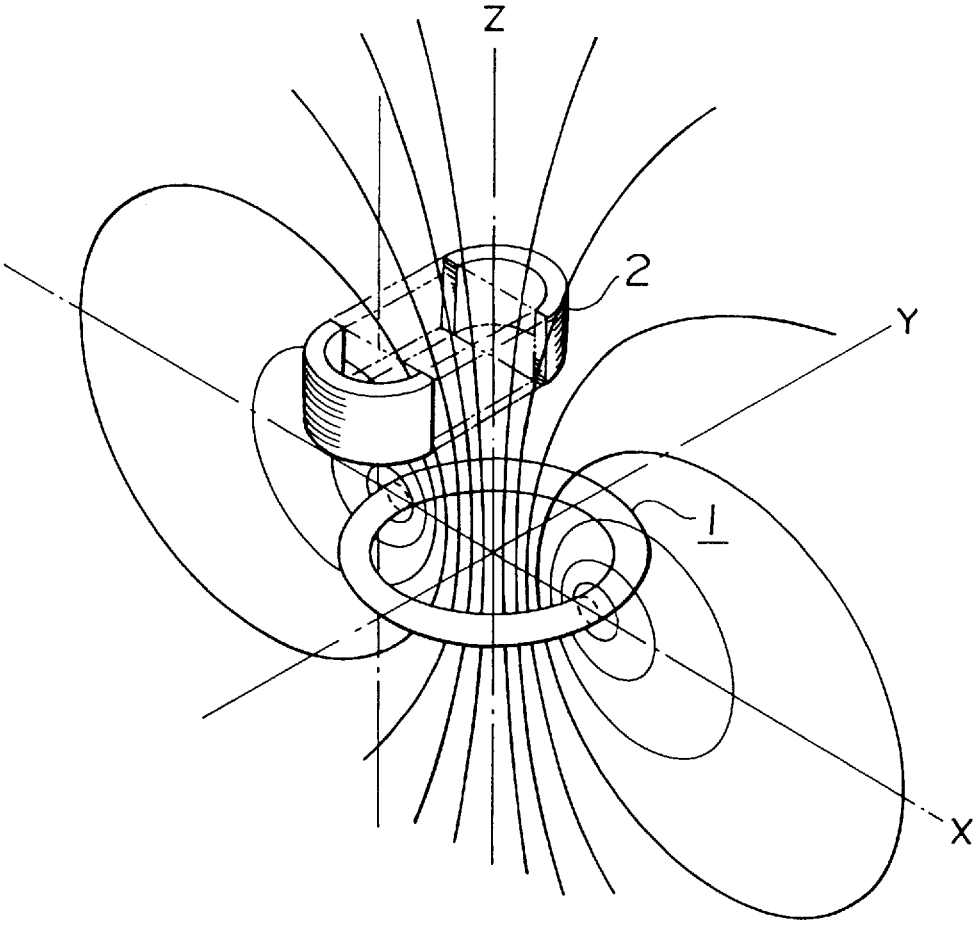
FIGS. 10 to 12 are illustrations available for describing the relationship between the direction of a reception coil and its reception sensitivity.
Figure 11:
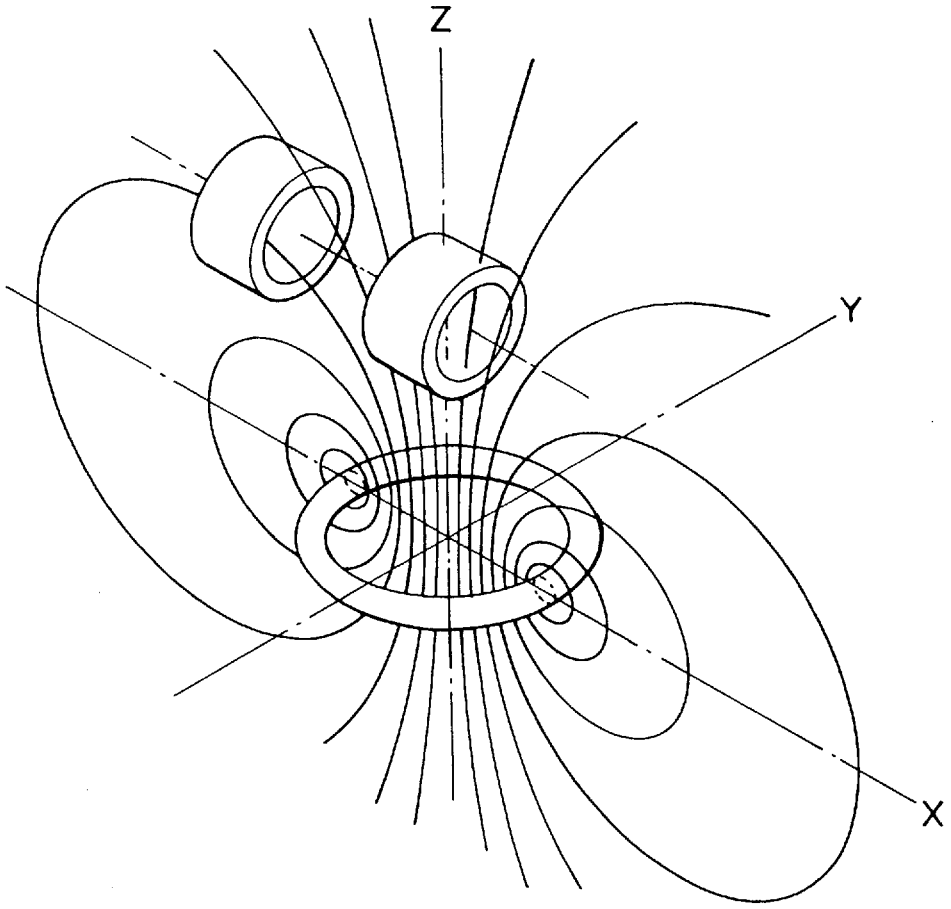
Figure 12:
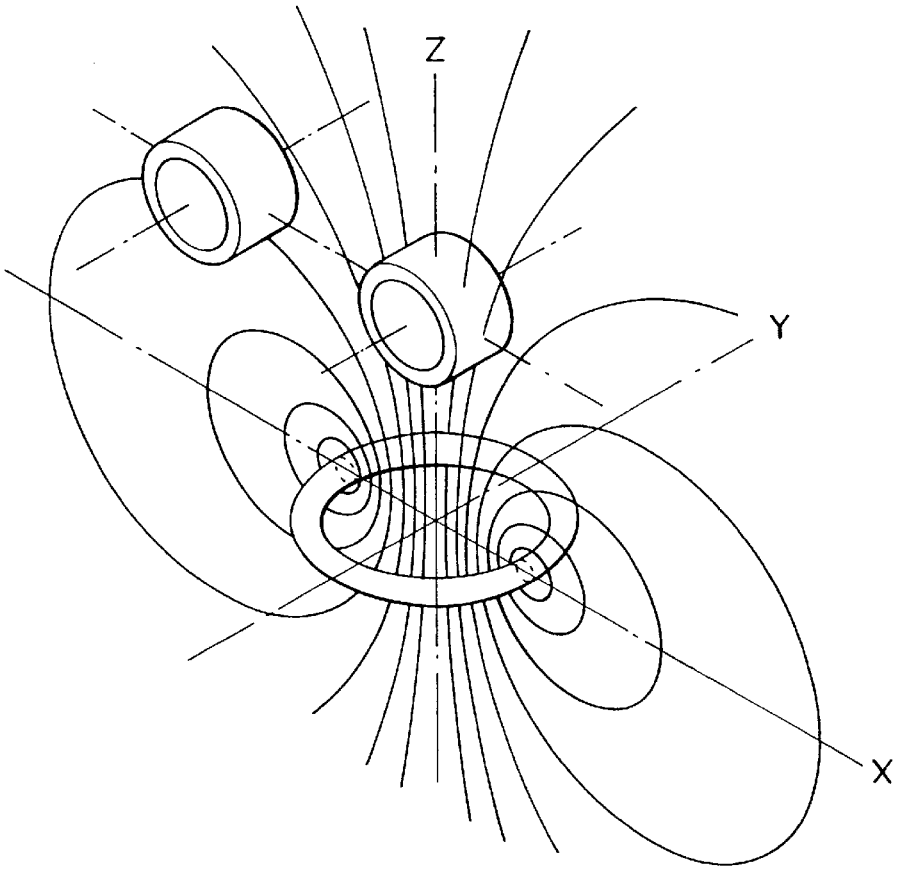

Furthermore, a description will be made of a disposition of the two transmission antennas. FIG. 5 is an illustration of an example where two transmission antennas are disposed on the floor in the doorway of a store; FIG. 6 is an illustration of an example in which two transmission antennas are vertically placed on the floor and at both sides of a doorway; FIG. 7 is an illustration of an arrangement of a gate useful for vertically setting a transmission antenna; and FIG. 8 is an illustration of an example in which two transmission antennas are situated vertically on the floor and at one side of a doorway.

The method in FIG. 5 of disposing the transmission antennas 1, 3 on the floor in the doorway of a store is the most common way, which allows the transmission antennas 1, 3 to be located in such a manner that the customers are not aware of the presence of the E.A.S. system. Although in the illustrated example the two transmission antennas 1, 3 are placed at the right-hand and left-hand sides to make right angles to the directions of the doorway, if the doorway is narrow, the location the two transmission antennas 1, 3 are preferably shifted from each other so as not to be situated along the doorway.

If the floor in the doorway is constructed with a steel plate which can absorb the magnetic fluxes and hence the transmission antennas 1, 3 can not be disposed on the floor surface, it is also possible that, as shown in FIGS. 6 and 7, the transmission antennas 1, 3 are put in pockets of screen-like gates and are placed together with the gates at the right-hand and left-hand sides of the doorway. Furthermore, it is also possible that, as shown in FIG. 8, the two transmission antennas 1, 3 are arranged vertically and fitted into a screen-like gate which in turn, is located at one side of the doorway.

In the case of the E.A.S. system according to the embodiment of this invention which uses two transmission antennas, the two transmission antennas can be disposed in various ways in a space in a doorway as described before, and even if the transmission antennas take any position, the system can sufficiently exhibit the monitoring effects. Incidentally, the tag with the reception coil to be attached to the goods may have the same structure as that of the prior art shown in FIG. 13.

Although in the above-described embodiment of this invention the two transmission antennas are alternately actuated in a time-sharing way, this invention can also cover the situation in which two or more transmission antennas are used and driven in a time-sharing way.

It should-be understood that the foregoing relates to only a preferred embodiment of the present invention, and that it is intended to cover all changes and modifications of the embodiment of the invention herein used for the purposes of disclosure, which do not constitute departures from the spirit and scope of the invention.

What is claimed is:

1. An electronic article surveillance (E.A.S.) system comprising:

at least two adjacent co-planer transmission antennas each for emitting magnetic fluxes both in the same chase to jointly form an interrogation zone;

means for actuating said transmission antennas in a time-sharing way such that said transmission antennas do not simultaneously emit the magnetic fluxes, said actuating means including:

an oscillator for generating a transmission signal having a basic frequency and a basic period; and a switching circuit for connecting said oscillator to said transmission antennas such that each transmission antenna is alternately connected to said oscillator for a time period which is at least two times as long as said basic period; and a tag for attaching to an article to be detected by the E.A.S. system, the tag including a reception coil for receiving the magnetic fluxes emitted from said transmission antennas;

the magnetic flux radiated from the at least two antennas having an intensity such that the tag may receive it at any location within said interrogation zone irrespective of tag orientation.

2. An E.A.S. system as defined in claim 1, wherein said transmission antennas are placed on a floor surface in a doorway.

3. An E.A.S. system as defined in claim 1, wherein said transmission antennas are placed in planes perpendicular to a floor surface and at both sides of a doorway.

4. An E.A.S. system as defined in claim 1, wherein said transmission antennas are placed in a plane perpendicular to a floor surface and at one side of a doorway.

5. An electronic article surveillance system comprising:

a first transmission antenna;

a second transmission antenna adjacent and co-planar with said first antenna;

a transmission circuit connected to said first and second transmission antennas, the transmission circuit including:

an oscillator for generating a transmission signal, and a switching circuit for connecting said oscillator to said first and second transmission antennas such that each of the first and second transmission antennas is alternately connected to said oscillator for a predetermined period, thereby causing said first and second transmission antennas to generate magnetic flux both in the same phase to jointly form an interrogation zone; and a tag including a reception coil for sensing said magnetic flux and an alarm signal generating means for generating an alarm signal when said reception coil senses said magnetic flux in said interrogation zone irrespective of tag orientation.

6. An electronic article surveillance system according to claim 5, wherein said predetermined period during which said first and said second transmission antennas are alternately connected to said oscillator is in the range of 20 msec to 67 msec.

7. An electronic article surveillance system according to claim 5, wherein said transmission antennas are placed on a floor surface in a doorway.

8. An electronic article surveillance system according to claim 5, wherein said transmission antennas are placed in planes perpendicular to a floor surface and at both sides of a doorway.

9. An electronic article surveillance system according to claim 5, wherein said transmission antennas are placed in a plane perpendicular to a floor surface and at one side of a doorway.

* * * * *

UNITED STATES PATENT AND TRADEMARK OFFICE

CERTIFICATE OF CORRECTION

PATENT NO. : 5,859,586

DATED : January 12, 1999

INVENTOR(S) : Sasagawa et al.

It is certified that error appears in the above-identified patent and that said Letters Patent is hereby corrected as shown below:

In the Claims

In claim 1, line 4, replace "co-planer" with --co-planar--.

In claim 1, line 5, replace "chase" with --phase--.

Signed and Sealed this

Seventeenth Day of August, 1999

*Attest:*

Q. TODD DICKINSON

*Attesting Officer*

*Acting Commissioner of Patents and Trademarks*